United States Patent [19]

Wittwer

[11] Patent Number: 4,715,280

[45] Date of Patent: Dec. 29, 1987

[54] POLE BODY FOR AN ELECTRIC FUZE, METHOD OF MANUFACTURING AND METHOD OF USING THE POLE BODY

[75] Inventor: Alfred Wittwer, Niederglatt, Switzerland

[73] Assignee: EMS-Inventa AG, Zürich, Switzerland

[21] Appl. No.: 725,959

[22] Filed: Apr. 22, 1985

[30] Foreign Application Priority Data

May 24, 1984 [CH] Switzerland ..... 2548/84

[51] Int. Cl.[4] ..... F42B 3/14; B65D 5/12

[52] U.S. Cl. ..... 102/202.8; 102/202.8; 427/124

[58] Field of Search ..... 102/202.5, 202.7, 202.8, 102/202.9; 427/91, 99, 97, 106, 107, 124, 125

[56] References Cited

U.S. PATENT DOCUMENTS

| | | | |
|---|---|---|---|
| 3,134,329 | 5/1964 | Zeman | 102/202.7 |
| 3,669,022 | 6/1972 | Dahn et al. | 102/202.7 X |
| 3,867,885 | 2/1975 | Gawlick et al. | 102/202.9 |
| 4,267,567 | 5/1981 | Nygaard et al. | 102/202.5 |
| 4,335,653 | 6/1982 | Bratt et al. | 102/202.9 X |
| 4,409,262 | 10/1983 | Jelks et al. | 427/124 X |
| 4,576,094 | 3/1986 | Meador | 102/202.7 X |

FOREIGN PATENT DOCUMENTS

| | | | |
|---|---|---|---|
| 2119907 | 11/1983 | United Kingdom | 102/202.5 |

*Primary Examiner*—Peter A. Nelson

[57] ABSTRACT

The pole body contains an insulating carrier element made of plastic and provided with elevations on one side and on an other side of the insulating carrier element. The elevation on the other side partially protrudes into a metal layer applied to the insulating carrier element and conjointly therewith forms a planar surface forming the two poles of the fuze. The pole body is manufactured by applying the metal layer to the insulating carrier element which is provided with wedge-shaped elevations. Subsequently, the tips or ridges of the elevations are removed to such an extent that planes including the metal layer are formed. One of the elevations constitutes an interrupted elevation and a number of detonating bridges is formed, depending on the number of interruptions in the elevation between the ends of the elevation bounded by the interruptions thereof. The pole body is used in electric fuze devices which have a reaction time in the microsecond range and thus are suited for use with ammunition.

26 Claims, 6 Drawing Figures

2 / 2

POLE BODY FOR AN ELECTRIC FUZE, METHOD OF MANUFACTURING AND METHOD OF USING THE POLE BODY

BACKGROUND OF THE INVENTION

The present invention relates to a new and improved pole body for an electric fuze device. The invention also relates to a new and improved method of manufacturing as well as to a method of using such pole body.

In its more particular aspects, the present invention specifically relates to a new and improved construction of a pole body for an electric fuze device and which contains an insulating carrier or support element at which at metal layer forms at least one detonating bridge.

In a pole body for an electric fuze device as known, for example, from German Pat. No. 2,840,738, the two pole protrude into a conductive metal layer. One of the pole is surrounded by a metal layer having an insulating gap or recess which metal layer is in contact with a detonator charge. A planar metal surface is arranged between the ends of the spiral-shaped gap and acts as a detonating bridge. Such gaps are generated in a simple manner by means of a laser beam.

Another electric fuze device as known, for example, from German Pat. No. 2,816,300, contains a detonating bridge which is arranged on a planar metal surface by means of a circular gap.

Thin detonating bridges of such kind have generally proven successful for electric fuzes with extreme short detonating times. They have, however, the disadvantage that their manufacture, due to the use of laser beams and due to the required costly installations for the generation of such laser beams, is extremely expensive. Additionally, the laser beam generating installations require careful servicing.

SUMMARY OF THE INVENTION

Therefore, with the foregoing in mind, it is a primary object of the present invention to provide a new and improved pole body for an electric fuze device which is of a construction permitting economic manufacture thereof in large numbers.

Another significant object of the present invention is directed to a new and improved construction of a pole body for an electric fuze device which does not require expensive engraving operations for producing an insulation and a detonating bridge in a metal layer.

A further important object of the present invention is directed to a new and improved construction of a pole body for an electric fuze which is substantially completely combustible.

Now in order to implement these and still further objects of the invention, which will become more readily apparent as the description proceeds, the pole body of the present development is manifested by the features that the insulating carrier or support element partially protrudes into the metal layer and forms a common plane with the surface of the metal layer.

In its simplest embodiment, the pole body comprises a carrier or support element and a metal layer. The carrier or support element contains members which protrude into the metal layer and are flush therewith, and thus insulates the conductive layer by means of these members.

Preferably, the inventive pole body contains a carrier or support element which is provided on one side thereof with a closed annularly shaped elevation and on the other side thereof with further interrupted elevation. The further elevation is interrupted by at least one detonating bridge. These elevations are integrally formed with the carrier or support element and possess in section the shape of a truncated cone in the finished pole body. This has the advantage that the conducting part and the insulating part of the pole body are undetachably interconnected and thus impart high strength to the pole body.

In a further design of the inventive pole body, the interrupted elevation is designed to possess a spiral shape and a detonating bridge is provided between the ends thereof. In this construction, the detonating bridge is formed and extends approximately parallel between the ends of the elevation.

Advantageously, the carrier or support element defines a rim portion and is provided with a step or shoulder at such rim portion. This step or shoulder facilitates the installation of the pole body in the electric fuze device which, for example, can be accomplished by simply clamping the pole body into a corresponding recess formed in the fuze device.

Preferably, the carrier or support element is provided with a central bore and at least two bores adjacent the rim portion of such carrier or support element. The electrical connections can be mounted in such bores.

Advantageously, the carrier or support element is manufactured from a homogeneous plastic part. Preferably, a plastic material is used which can be processed by injection molding, which is chemically resistant and which withstands elevated temperatures. Preferably, the following plastic materials are suited for the carrier or support element of the inventive pole body: polyamides, polycarbonates, polyoximethylene, polytetrafluoroethylene, polyurethanes, epoxide resins, ureaformaldehyde resins, cross-linked polyethylene and, particularly, filled polyamides or epoxide resins.

It is of particular advantage if the pole body is substantially completely combustible. The aforementioned plastic materials have the advantage that in practice they substantially completely burn-up in a detonator cap.

As alluded to above, the present invention is not only concerned with the aforementioned construction aspects, but also relates to a new and improved method of manufacturing a pole body containing an insulating carrier element.

In order to achieve the aforementioned measures, the inventive method comprises the steps of:

providing an insulating carrier or support element which possesses a central bore, at least two further bores adjacent a rim portion of the insulating carrier or support element, a closed annular elevation with a substantially wedge-shaped profile on one side and an interrupted endless or non-closed elevation on an other side of said insulating carrier or support element;

applying at least one metal layer to the insulating carrier or support element and through the central bore and the further bores thereof; and removing tips or ridges of the closed elevation and of the interrupted elevation down to respective planes defined by the metal layer.

The elevations may have a continuous arcuate shape but, in deviation therefrom, may also be structured in a zig-zag shape, in an undulating shape or in a meander-shape. It is of advantage and particularly economical to manufacture the pole body in essentially only two primary method steps constituting the aforementioned metal layer application and the ridge removal.

Preferably, the metal layer is mechanically and/or chemically applied to and/or vapor-deposited under high-vacuum on the carrier or support element. There are thus formed good electrically conducting and mechanically strong, thin layers.

In a preferred embodiment of the inventive method, a metal layer is first vapor-deposited under high-vacuum, a further metal layer is chemically-deposited thereupon, and then again a metal layer is vapor-deposited upon the other layers thus formed.

Advantageously, the ridges or tips of the elevations on both sides of the carrier or support element are simultaneously removed down to the related plane of the metal layer. One process step thus can be saved.

Preferably, the elevations are removed by melting-off and/or grinding-off the elevations. During the melting-off and/or grinding-off operation, the elevations, i.e. their tips or ridges, are removed down to the plane of the metal layer. There are thus formed clean surfaces which have the required precision in the micrometer range.

The inventive pole body is particularly suitable for use in electric fuze devices for detonating ammunition like, for example, projectiles, rockets, explosive charges and hollow charges.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawing there have been generally used the same reference characters to denote the same or analogous components and wherein.

DETAILED DESCRIPTION OF THE PREFERRED EMBODIMENTS

Figure 1:
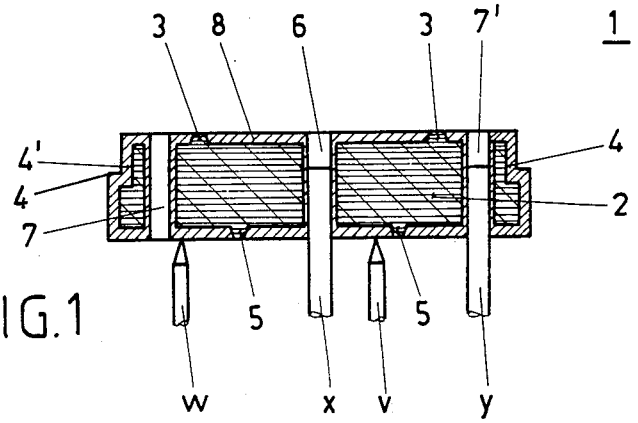
FIG. 1 is an axial section through a first embodiment of the inventive pole body.

Describing now the drawings, it is to be understood that only enough of the construction of the pole body has been shown as is needed for one skilled in the art to readily understand the underlying principles and concepts of the present development, while simplifying the showing of the drawings. Turning attention now specifically to FIG. 1, a first exemplary embodiment of the inventive pole body is generally designated by reference character 1. This pole body 1 contains a carrier or support element 2 which is made of plastic and which comprises on one side 2' thereof, an elevation or protuberance 3 having the profile of a truncated cone. In the most simple case, this elevation 3 forms a circular ring. The elevation 3 may also possess any other suitable geometric shape, however, must have a closed configuration. On the opposite side 2", the insulating carrier or support element 2 comprises a further elevation or protuberance 5 of a simpler kind and this further elevation 5 has a smaller diameter and is not closed to form a ring.

A circumferential or rim portion 4' of the carrier or support element 2, is provided with a step or shoulder 4. The carrier or support element 2 is further provided with a central bore 6 and one or more further bores of which two bores 7 and 7' are shown and which are located adjacent the rim portion 4' of the carrier or support element 2.

The pole body 1 is continuously plated with a metal layer 8 which extends over its entire surface and also through the interior of the central bore 6 and the further bores 7 and 7'. The metal layer 8 generally comprises a number of layers. The electrical connections x and y can be attached to the central bore 6 and the further bores 7 and 7'. Such connections can also be attached to the indicated locations at the metal layer 8 as alternative connections v and w.

Figure 2:
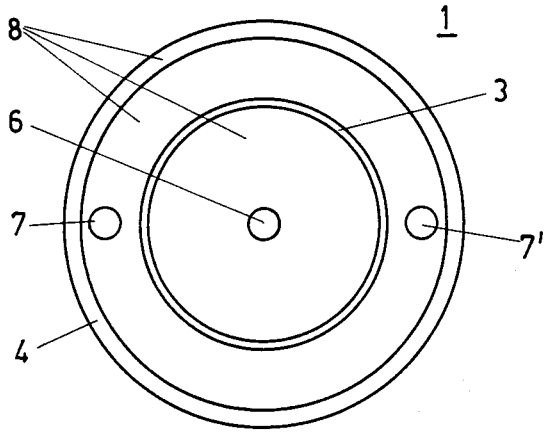
FIG. 2 is a top plan view of the pole body shown in FIG. 1.

In the top plan view of the pole body 1 illustrated in FIG. 2, the surface of the elevation 3 of the insulating carrier or support element 2 is shown between the central bore 6 and the further bores 7 and 7'. The step or shoulder 4 of the carrier or support element 2 forms a peripheral flange and serves for mounting the pole body 1 in a fuze device.

Figure 3:
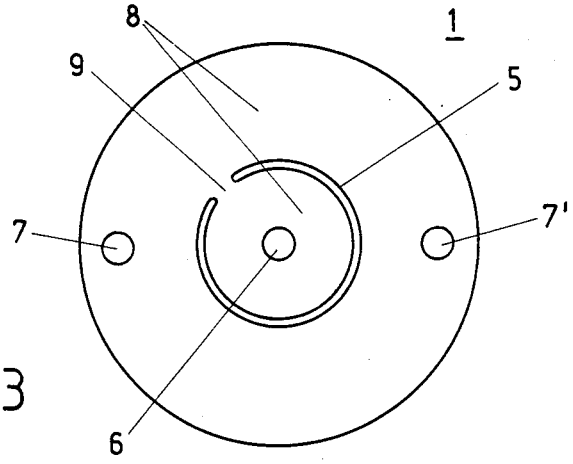
FIG. 3 is a view from below of the pole body shown in FIG. 1.

A view from below of the pole body 1 is shown in FIG. 3 and there is illustrated therein a detonating bridge 9. This detonating bridge 9 forms a gap between the ends of the generally annularly shaped elevation 5 which is present on the other side 2" of the carrier or support element 2.

Figure 4:
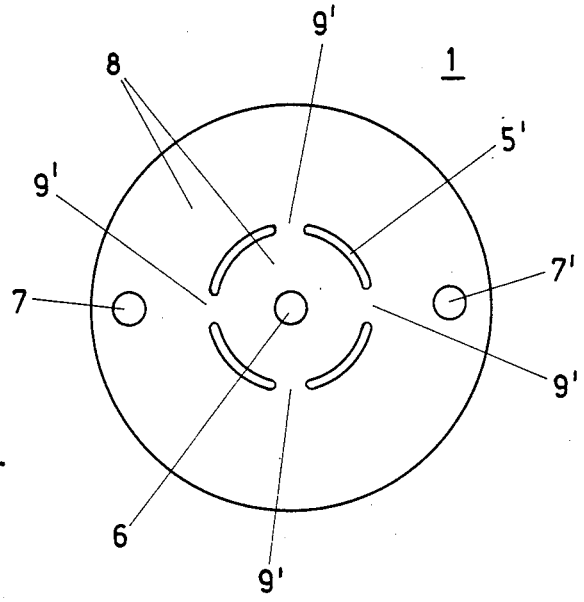
FIG. 4 is a view from below of a second embodiment of the inventive pole body.

FIG. 4 shows a view from below of a second exemplary embodiment of the inventive pole body 1 in which the elevation or protuberance 5' is interrupted by a number of detonating bridges 9'. As illustrated, four detonating bridges 9' are shown for this exemplary embodiment.

Figure 5:
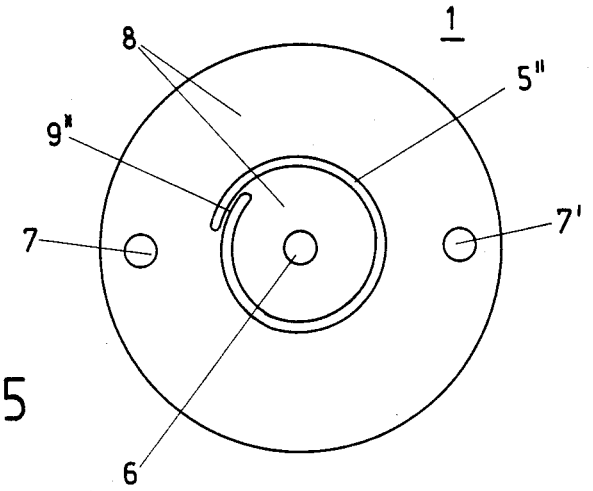
FIG. 5 is a view from below of a third embodiment of the inventive pole body.

FIG. 5 shows a view from below of a third exemplary embodiment of the invention pole body 1, and in this embodiment a detonating bridge 9" is present between the ends of a spiral-shaped elevation 5".

Figure 6:
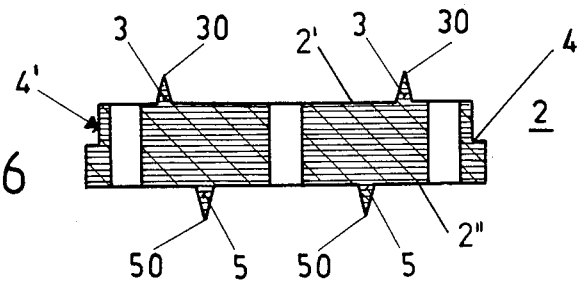
FIG. 6 is an axial section through an uncoated carrier or support element contained in the inventive pole body.

FIG. 6 shows the unworked insulation carrier or support element 2 with the elevations or protuberances 3 which have the profile or sectional shape of a truncated cone, on the one side 2', and with the elevations or protuberances 5 on the other side 2" on which the detonating bridge or bridges are formed. This insulating carrier or support element 2 is also shown provided with the aforementioned step or shoulder 4. This unworked carrier or support element 2 is removed as a blank from an injection mold and constitutes a homogeneous plastic member. The elevations 3 and 5 are provided with tips or ridges 30 and 50, respectively.

For manufacturing the pole body 1, the carrier or support element 2 illustrated in FIG. 6 and described hereinbefore with reference to such FIG. 6, is provided with a continuous metal layer 8, for example, by vapor-depositing the metal under high-vacuum at its surfaces as well as throughout the bores 6, 7 and 7'. The following metals are suited for this purpose and there can be used the individual metals or suitable alloys thereof: nickel, chromium, aluminum, palladium, tantalum, manganese, barium, titanium, rhenium and gold. After the application of the metal layer 8 by vapor-deposition, a further metal layer of silver or gold and having a thickness in the range of about 1 to about 50 micrometers is chemically applied. There can then be vapor-deposited under high-vacuum in known manner a further layer of one of the aforementioned metals or an alloy of such metals.

After formation of the metal layers, preferably both sides are simultaneously leveled by a melting-off or grinding-off operation. During this operation, the tips or ridges 30 and 50 of the elevations 3 and 5, 5' or 5'' are respectively removed. There is thus obtained a metallic surface which is only divided by the insulating plastic surface and which contains at one side the desired detonating bridge 9, 9' or 9''.

The inventive pole body as described hereinbefore has the advantage that it is very simple in its structure, compact and stable due to the non-interrupted connection between the insulating carrier or support element 2 and the conductive part of the metal layer 8. The inventive pole body 1 is nonetheless practically completely combustible. The inventive pole body 1 can be readily assembled with a fuze device and can be economically manufactured in large numbers.

The pole body 1 as described hereinbefore with reference to FIGS. 1 to 6, can be used in electric fuze devices of all types, particularly in combination with electric fuze devices in ammunition.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A pole body for an electric fuze, comprising:
an insulating carrier element;
a metal layer provided on said insulating carrier element and forming at least one detonating bridge;
said metal layer on said insulating carrier element defining a surface; and
said insulating carrier element partially protruding into said metal layer on said insulating carrier element and forming a common plane with said surface of said metal layer.

2. The pole body as defined in claim 1, wherein:
said insulating carrier element defines one side and an other side;
a closed annular elevation formed on said one side of said insulating carrier element;
an interrupted elevation formed on said other side of said insulating carrier element; and
said further elevation being interrupted by said at least one detonating bridge.

3. The pole body as defined in claim 2, wherein:
said interrupted elevation constitutes a substantially spiral-shaped elevation having two ends; and
said detonating bridge being provided between said two ends of said substantially spiral-shaped elevation.

4. The pole body as defined in claim 1, wherein:
said insulating carrier element defines a rim portion; and
said insulating carrier element being provided at said rim portion with a step.

5. The pole body as defined in claim 1, wherein:
said insulating carrier element is provided with a central bore and defines a rim portion; and
said insulating carrier element being further provided adjacent said rim portion with at least two further bores.

6. The pole body as defined in claim 1, wherein:
said insulating carrier element is made of a homogeneous plastic member.

7. The pole body as defined in claim 1, wherein:
said insulating carrier element constitutes a substantially completely combustible element.

8. The pole body as defined in claim 1, wherein:
said pole body is used in an electric fuze for detonating ammunition.

9. A method of manufacturing a pole body containing an insulating carrier element, said method comprising the steps of:
providing an insulating carrier element which possesses a central bore, at least two further bores adjacent a rim portion of said insulating carrier element, a closed annular elevation possessing a substantially wedge-shaped profile on one side and an interrupted elevation on an other side of said insulating carrier element;
applying at least one metal layer to said insulating carrier element and through said central bore and said further bores thereof; and
removing ridges of said closed elevation and of said interrupted elevation down to respective planes defined by said metal layer.

10. The method as defined in claim 9, wherein:
said step of applying said at least one metal layer entails mechanically applying said at least one metal layer to said insulating carrier element.

11. The method as defined in claim 9, wherein:
said step of applying said at least one metal layer entails chemically applying said at least one metal layer to said insulating carrier element.

12. The method as defined in claim 9, wherein:
said step of applying said at least one metal layer entails mechanically and chemically applying said at least one metal layer to said insulating carrier element.

13. The method as defined in claim 9, wherein:
said step of applying said at least one metal layer entails vapor-depositing said at least one metal layer to said insulating carrier element.

14. The method as defined in claim 9, wherein:
said step of applying said at least one metal layer entails mechanically applying and vapor-depositing said at least one metal layer to said insulating element.

15. The method as defined in claim 9, wherein:
said step of applying said at least one metal layer entails chemically applying the vapor-depositing said at least one metal layer to said insulating carrier element.

16. The method as defined in claim 9, wherein:
said step of applying said at least one metal layer entails mechanically and chemically applying and vapor-depositing said at least one metal layer.

17. The method as defined in claim 9, wherein:
said step of removing said ridges of said closed elevation and of said interrupted elevation entails simultaneously removing said ridges of said closed elevation on said one side and said ridges of said interrupted elevation on said other side of said insulating carrier element down to said respective planes defined by said metal layer.

18. The method as defined in claim 17, wherein:

said step of removing said ridges of said closed elevation and of said interrupted elevation entails removing said ridges of said closed elevation and of said interrupted elevation by means of a melting-off operation.

19. The method as defined in claim 17, wherein:

said step of removing said ridges of said closed elevation and of said interrupted elevation entails removing said ridges of said closed elevation and of said interrupted elevation by means of a grinding-off operation.

20. The method as defined in claim 17, wherein:

said step of removing said ridges of said closed elevation and of said interrupted elevation entails removing said ridges of said closed elevation and of said interrupted elevation by means of a melting-off and a grinding-off operation.

21. A method of using a pole body comprising an insulating carrier element with at least two bores, a closed elevation on one side and an interrupted elevation on an other side thereof, a metal layer applied to said insulating carrier element and through said at least two bores thereof, and at least one detonating bridge formed by at least one interruption of said interrupted elevation on said other side of said insulating carrier element, in an electric fuze for detonating ammunition.

22. The method as defined in claim 21, wherein:

said step of using said pole body entails using said pole body in an electric fuze for detonating projectiles.

23. The method as defined in claim 21, wherein:

said step of using said pole body entails using said pole body in an electric fuze for detonating rockets.

24. The method as defined in claim 21, wherein:

said step of using said pole body entails using said pole body in an electric fuze for detonating explosive charges.

25. The method as defined in claim 21, wherein:

said step of using said pole body entails using said pole body in an electric fuze for detonating hollow charges.

26. The pole body as defined in claim 1, wherein:

said surface of said metal layer defines an outer surface of the pole body.

* * * * *

UNITED STATES PATENT AND TRADEMARK OFFICE

CERTIFICATE OF CORRECTION

PATENT NO. : 4,715,280

DATED : December 29, 1987

INVENTOR(S) : ALFRED WITTWER

It is certified that error appears in the above-identified patent and that said Letters Patent is hereby corrected as shown below:

Column 1, line 15, after "which" please delete "at" and insert --a--

Column 1, line 19, before "is" please delete "pole" and insert --poles--

Column 4, line 4, please delete "simpler" and insert --similar--

Column 4, line 45, please delete "insulation" and insert --insulating--

Column 6, line 49, after "insulating" please insert --carrier--

Column 7, line 18, after "comprising" please insert --using--

Signed and Sealed this

Nineteenth Day of July, 1988

*Attest:*

DONALD J. QUIGG

*Attesting Officer*

*Commissioner of Patents and Trademarks*